United States Patent [19]

Mitchell et al.

[11] 4,303,497

[45] Dec. 1, 1981

[54] DESULFURIZATION, DEMETALATION AND DENITROGENATION OF COAL

[75] Inventors: Thomas O. Mitchell, Trenton; Darrell D. Whitehurst, Titusville; Malvina Farcasiu, Princeton, all of N.J.

[73] Assignee: Mobil Oil Corporation, New York, N.Y.

[21] Appl. No.: 142,189

[22] Filed: Apr. 21, 1980

Related U.S. Application Data

[63] Continuation of Ser. No. 945,281, Sep. 25, 1978, abandoned.

[51] Int. Cl.[3] ..... C10G 29/16

[52] U.S. Cl. ..... 208/10; 208/9; 208/56; 208/214; 208/251 R; 208/254 R

[58] Field of Search ..... 208/214, 56, 9, 10, 208/251 R, 251 H, 254 R, 254 H

[56] References Cited

U.S. PATENT DOCUMENTS

| | | | |
|---|---|---|---|
| 2,591,525 | 4/1952 | Engel et al. | 208/214 |
| 2,987,470 | 6/1961 | Turken | 208/253 |
| 3,184,401 | 5/1965 | Gorin | 208/8 R |
| 3,772,185 | 11/1973 | Chang et al. | 208/253 X |
| 3,916,479 | 2/1973 | Weisz et al. | 208/211 |
| 3,936,371 | 2/1976 | Veda et al. | 208/253 X |
| 3,985,548 | 10/1976 | Leas et al. | 208/8 LE |

*Primary Examiner*—Delbert E. Gantz
*Assistant Examiner*—G. E. Schmitkons
*Attorney, Agent, or Firm*—Charles A. Huggett; Michael G. Gilman; Charles J. Speciale

[57] ABSTRACT

The specification discloses a desulfurization, demetalation and denitrogenation process for coal and coal liquid charge stocks. The process comprises contacting the charge stock in the absence of externally added hydrogen with a hydrogen donor solvent in the presence of a catalytic amount of naturally occurring porous metal ores such as manganese nodules, bog iron, bog manganese, nickel laterites, bauxite or spent bauxite.

12 Claims, No Drawings

DESULFURIZATION, DEMETALATION AND DENITROGENATION OF COAL

This is a continuation of application Ser. No. 945,281 filed Sept. 25, 1978, now abandoned.

BACKGROUND OF THE INVENTION

1. Field of the Invention

This invention relates to the treatment of coal or coal liquids and more particularly to the catalytic treatment of coal and coal liquids to effect removal of sulfur, nitrogen and metal compounds.

2. Description of Prior Art

The use of manganese compounds in the desulfurization of petroleum fractions is well known. U.S. Pat. No. 3,320,157 discloses contacting a hydrocarbon fraction at temperatures between 500° and 750° F. with manganese hydroxide or hydrous manganese oxide for removing sulfur. U.S. Pat. No. 3,330,096 removes sulfur compounds from gases in which manganese nodules are used. U.S. Pat. No. 3,214,236 discloses desulfurization, denitrogenation and hydrogenation wherein manganese nodules are catalytically useful. U.S. Pat. No. 3,509,041 discloses ion exchange of manganese nodules with hydrogen ions to provide compositions useful in hydrocarbon conversion reactions such as cracking, hydrocracking, oxidation, olefin hydrogenation and isomerization. U.S. Pat. No. 3,983,030 and 3,813,331 are further representative of demetalization and desulfurization of petroleum residua with manganese nodules.

It is also known that certain compounds of iron are useful in the desulfurization of coal. U.S. Pat. No. 3,909,213 discloses the use of metal chloride salts such as ferric chloride as capable of dissolving sulfur-containing organic compounds in coal. In U.S. Pat. No. 3,768,988, ferric ions are employed to remove pyritic sulfur from coal. U.S. Pat. No. 3,999,958 discloses the reaction of ferromagnetic particles with coal to remove sulfur.

SUMMARY OF THE INVENTION

In accordance with the invention, desulfurization, demetalation and denitrogenation of coal or coal liquid charge stocks is carried out by contacting the charge stock in the absence of externally added hydrogen with a hydrogen donor solvent in the presence of a catalytic amount of a naturally occurring porous metal ore, such as manganese nodules, bog iron, bog manganese, nickel laterites, bauxite or spent bauxite.

DESCRIPTION OF PREFERRED EMBODIMENTS

The conversion of coal to liquid and gaseous fuel products is of ever increasing importance because of the vast reserves of coal compared to the supply of liquid petroleum. Coal and heavy liquids derived from coal are of low quality because of low hydrogen content and high heteroatom content. These materials can be used as residual or boiler fuels or catalytically upgraded to economically, more desirable liquid and ashless coal products. The catalytic conversion of coal, however, requires a catalyst that is resistant to poisoning by metal contaminants. Additionally, large amounts of sulfur, nitrogen and oxygen further decrease the overall activity of the catalyst. Although various hydrodesulfurization processes have been suggested, such processes are costly because of the high consumption of hydrogen.

By the process of the invention, a simple and inexpensive catalyst has been discovered for use in the desulfurization, demetalation and denitrogenation of coal in the absence of externally added hydrogen and in the presence of a hydrogen donor solvent. The catalyst comprises a naturally occurring porous metal ore such as manganese nodules, bog iron, bog manganese, nickel laterites or bauxite. Such materials are readily available in large quantities and are relatively inexpensive. Further, such ores are capable of effective desulfurization and denitrogenation as well as removing metallic impurities from the coal charge stock. When the porous catalyst material becomes fouled and inactivated in the process, such materials can be discarded without significant effect on the economics of the process because of their low cost.

Manganese nodules, as is known, are naturally occurring deposits of manganese, along with other metals, including iron, cobalt, nickel, and copper, found on the floor of bodies of water. They are found in abundance on the floors of oceans and lakes. For example, they are found in abundance on the floor of the Atlantic and Pacific Oceans and on the floor of Lake Michigan. The nodules are characterized by a large surface area, i.e., in excess of 150 square meters per gram. The nodules have a wide variety of shapes but most often those from the oceans look like potatoes. Those from the floor of bodies of fresh water, such as the floor of Lake Michigan, tend to be smaller in size. Their color varies from earthy black to brown depending upon their relative manganese and iron content. The nodules are porous and light, having an average specific gravity of about 2.4. Generally, they range from $\frac{1}{8}$ to 9 inches in diameter but may extend up to considerably larger sizes approximating 4 feet in length and 3 feet in diameter and weighing as much as 1700 pounds. In addition to the metals mentioned above, the nodules contain silicon, aluminum, calcium and magnesium, and small amounts of molybdenum, zinc, lead, vanadium, and rare earth metals.

The chemical and physical properties of manganese nodules, as catalytic agents for the desulfurization of hydrocarbon charge stocks, are, as compared with conventional catalytic agents for this purpose, considered to be somewhat unusual. The nodules have a high surface area, about 100–250 square meters per gram. They will, however, lose surface area by metal deposition during the desulfurization reaction. Further, as shown by Roger G. Burns and D. W. Fuerstenau in American Mineralogist, vol. 51, 1966, pp. 895–902, "Electron-Probe Determination of Inter-Element Relationships in Manganese Nodules," the concentrations of the various metals contained in the nodules, i.e., the manganese, iron, cobalt, copper, and nickel, are not uniform throughout the crystalline structure of the nodule. Rather, a traverse across a section of a nodule will show marked differences in the concentrations of the various metals from point to point of the traverse. However, there appears to be a correlation between the concentrations of iron and cobalt. On the other hand, manufactured catalysts are usually as uniform as the manufacturer can achieve.

The manganese nodules can be employed as the catalyst for the desulfurization/demetalation/denitrogenation of the coal charge stock substantially as mined, or recovered, from the floor of the body of water in which they occurred. Thus, the nodules, as mined, possibly after washing to remove sea water or lake water therefrom and mud or other loose material from the surface of the nodules, may be employed.

The process of the invention may also be carried out employing, as the catalyst, manganese nodules which have been subjected to a pretreatment. Pretreatment to which the manganese nodules may be subjected includes sulfiding or leaching to remove therefrom one or more components of the nodules.

Sulfiding of the manganese nodules can increase the extent of demetalizing of the charge stock. It also can increase the extent of desulfurization and Conradson Carbon Residue (CCR) reduction, each of which is desirable. This treatment is carried out, for instance, by contacting the nodules with hydrogen sulfide. The hydrogen sulfide may be pure or may be mixed with other gases. However, the hydrogen sulfide should be substantially free of hydrogen. The temperature of sulfiding may be from about 300° F. to about 450° F. and the time of sulfiding may be from about 4 to 8 hours. The sulfiding may be effected, for example, by passing the hydrogen sulfide over the manganese nodules continuously during the sulfiding reaction. The space velocity of the hydrogen sulfide is not critical and any space velocity compatible with the equipment and such that some hydrogen sulfide is continuously detected in the exit stream is suitable.

The manganese nodules may also be pretreated by being subjected to leaching to remove therefrom one or more components. As mentioned previously, the manganese nodules contain, in addition to manganese, copper, nickel, and molybdenum. They may be pretreated to leach therefrom the copper, nickel, or molybdenum, or any two, or all three, of these metals. The manganese nodules contain the copper, nickel, and molybdenum in sufficient quantities to provide a commercial source of these metals. Further, the removal, at least partially, of these metals and other of the metallic constituents of the nodules has apparently no deleterious effect on the catalytic activity of the nodules. Thus, by this embodiment of the invention, copper, nickel, and molybdenum, and other metals, may be recovered from the nodules for the economic advantage to be gained by such recovery and the remainder of the manganese nodules can then be employed as a catalyst.

Removal of the copper and the nickel may be effected by leaching the manganese nodules with an aqueous solution of a strong acid. By strong acid is meant such acids as hydrochloric, sulfuric, and nitric acids.

The molybdenum may be removed from the manganese nodules by leaching them with aqueous base solutions such as aqueous solutions of sodium hydroxide or sodium carbonate. These solutions should have a pH of at least 8 and preferably should have a pH of at least 10. The leaching with the aqueous base solutions can be carried out at ambient temperatures or at the boiling point of the solution.

The nodules, with or without pretreatment, may be crushed and sized to obtain a desired particle size depending upon the type of operation employed, for example, a fixed bed operation, an ebullated bed operation or otherwise.

The catalyst, after being employed and having become catalytically deactivated or spent, can be treated for recovery of valuable metals such as copper, nickel, molybdenum, and the like. It may also be treated to recover any other component.

Another naturally occurring porous metal ore which can be used for the desulfurization/demetalation/denitrogenation process is the loosely aggregated ore obtained from marshy ground which is known as bog iron. Bog iron is a variety of limonite, a naturally occurring hydrated oxide of iron ($2Fe_2O_3.3H_2O$) which contains about 60 weight percent iron. It is yellow to brown in color and has been formed by the alteration of other iron minerals, e.g., by oxidation and/or hydration. Bog iron is a common and important ore found in the United States and Europe. It is amorphous and is characterized by a surface area in excess of 10 square meters per gram, a hardness (Mohs) of about 5 to 5.5, and an average specific gravity of about 3.6 to 4.

The bog iron can be employed substantially as mined but is preferably washed with hot water to remove mud and other loose material. The iron is then crushed, dried to a constant weight and sieved to 10–20 mesh (U.S. Series). If desired, the bog iron may be leached and/or sulfided in the manner indicated above for manganese nodules.

Bog manganese is another naturally occurring porous metal ore which can be used. This ore may also be pretreated by leaching and/or sulfided. Bog manganese is similar to bog iron and consists mainly of oxide of manganese and water, with some oxide of iron, and often silica, alumina, baryta. It is amorphous, has a surface area greater than 10 square meters per gram, a hardness (Mohs) of about 6 and a specific gravity of about 3.0 to 4.26. Bog manganese is not regarded as representing a distinct mineral species from psilomelane, a colloidal manganese oxide with various adsorbed impurities. Bog manganese occurs in Europe and is associated with the Lake Superior hematite deposits in Michigan.

Other suitable ores having a surface area in excess of 10 squares meters per gram which can be employed include nickel bearing laterite ores and bauxite. Also included is spent bauxite or the red mud by-product obtained in the Bayer process of manufacturing aluminum from bauxite. Lateritic nickel ores of the silicate type, such as the usual laterites and garnierites, are found in southeast Asia, Cuba, Czechoslavakia, New Caledonia, the Phillipines, Indonesia, Greece, Yugoslavia, Guatemala and Venzuela. These ores normally contain free and combined water and analyze on a dry basis less than 3 weight percent nickel, less than 0.15 weight percent cobalt and more than 15 weight percent iron. A typical analysis of laterite ore is as follows.

TABLE I

| | Wt. % Dry | Wt. % Dry | |
|---|---|---|---|
| Ni + Co | 2.3 | 2.9 | as NiO |
| Fe | 18.5 | 26.5 | as $Fe_2O_3$ |
| Cr | 1.2 | 1.7 | as $Cr_2O_3$ |
| MgO | 15 | 15 | |
| $SiO_2$ | 35 | 35 | |
| $Al_2O_3$ | 4.5 | 4.5 | |
| CAO | 0.1 | 0.1 | |
| LOI | 11.5 | 11.5 | |
| Unacct. | | 2.8 | |
| | | 100 | |

Bauxite is a naturally occurring porous ore having a typical composition as follows:

TABLE II

| | wt. % |
|---|---|
| $Al_2O_3$ | 40–60 |
| $Fe_2O_3$ | 1.5–30 |
| $SiO_2$ | 1–8 |
| $TiO_2$ | 2–4 |

TABLE II-continued

| | wt. % |
|---|---|
| Water | 12–30 |

Bauxite ores are found in considerable deposits on Kauai in the Hawaiian Islands, in Oregon, Washington, Arkansas, Jamaica, British Guiana, Costa Rica, France, Italy, Yugoslavia, Indonesia and elsewhere throughout the world.

Bauxite and nickel ores are ideally suited as catalysts for the process of the invention and can be used directly as mined and without further upgrading. If desired, these ores may be pretreated by leaching and/or sulfided in the manner heretofore described.

Spent bauxite or red mud is ideally suited as a catalyst in the process of the invention since it is available in large quantities and is relatively inexpensive. Red mud is a by-product obtained in the Bayer aluminum process. This process involves digestion of bauxite in caustic solution, generally sodium hydroxide, usually at elevated temperatures and pressures. Digestion of the ore results in a slurry consisting of a sodium aluminate solution and a caustic-insoluble residue, commonly referred to as spent bauxite or red mud. The red mud or spent bauxite is washed to recover most of its entrained liquor content and is then removed as a by-product from the process. Red mud contains a substantial amount of zeolite desilication product admixed with iron, titanium and/or other materials not normally soluble in caustic. The zeolite material or desilication product generally has a formula expressed in mole ratio of oxides as follows:

$$4Na_2O:3Al_2O_3:3SiO_2:Y$$

wherein Y is $SO_3$, Cl, OH, and $CO_2$ depending on the impurities in the liquor from which the zeolite was precipitated.

The desulfurization/demetalation/denitrogenation process is carried out in the presence of a hydrogen donor solvent. An amount of coal and solvent will generally be used such that the weight ratio of solvent to coal will be from 0.5 to 8:1, preferably about 2:1. The donor solvent materials are well known and among suitable donor materials there may be mentioned hydroaromatic, naphthene-aromatic and compounds such as hydronaphthalenes, for example, Tetralin, hydroanthracenes, hydrophenanthrenes and the like. Compounds having at least 1 and preferably 2, 3 or 4 aromatic nuclei and being partially hydrogenated to include aromatic resonance and containing olefinic bonds serve as excellent hydrogen donors. Fully aromatic structures are ineffective as hydrogen donors. Completely hydrogenated condensed ring molecules have only a small hydrogen transfer propensity. Therefore hydrogen donors are preferentially created by partial hydrogenation of polynuclear aromatics to introduce on the average from about 1 to about 3 hydrogen molecules, leaving at least one ring partially hydrogenated.

It will be understood that the hydrogen donor solvent may be obtained from any source. Of particular value are the solvents available from coal processing systems, e.g., an intermediate stream boiling between 350° F. and about 900° F., preferably between about 400° F. and 700° F., derived from a coal liquefaction process. Streams of this type comprise hydrogenated aromatics, naphthenic hydrocarbons, phenolic materials and similar compounds, and contain at least 30 weight percent up to 50 weight percent of compounds which are known to be hydrogen donors. See, for example, U.S. Pat. No. 3,841,991, the teachings of which are hereby incorporated by reference. The hydrogen donor solvent material can be regenerated externally by conventional means, e.g., catalytic hydrogenation, and may be recycled if desired. The recycle donor solvent need not be a pure hydrogen donor material or a mixture of the same but can be substantially diluted with an inert solvent.

Other hydrogen-containing solvents may be used instead of, or in conjunction with either petroleum or coal derived solvents. Such materials include water miscible and immiscible lower aliphatic alcohols such as methanol, ethanol, propanol, isopropanol; butanol, pentanol, hexanol; cycloaliphatic alcohols, such as cyclohexanol, and ethers such as dimethyl ether, diethyl ether, etc.

The desulfurization/demetalation/denitrogenation reaction is carried out by contacting the coal charge stock with the catalyst in the presence of a hydrogen donor solvent material. The temperature employed will range from about 450° F. to about 1050° F. and is preferably about 650° to 850° F. The amount of catalyst used in the process may vary over a wide range, but the usual amount will be from about 0.5 to 100% by weight based on the weight of coal, preferably about 1 to 20 percent by weight. The coal charge stock along with the solvent may be passed upwardly through a fixed bed of the catalyst in an upflow reactor or may be passed downwardly through a fixed bed of the catalyst in a downflow trickle-bed reactor. The reaction may also be carried out by passing the charge stock and solvent through an ebullient bed of the catalyst. The reaction may also be carried out by contacting the charge stock solvent and catalyst in a batch reactor.

Any solid carbonaceous material may be employed as "coal" in the process of this invention including natural coals such as high- and low-volatile bituminous, lignite, brown coal, peat, etc., or solvent-refined coal or related "modified" coal. The coal may be high-ash, high-metals, high-sulfur, and have poor caking characteristics, and still be quite suitable for this process scheme. The process scheme is particularly useful in removing the last most difficult-to-remove sulfur in order to meet combustion specifications in natural coals or solvent-refined coals. The coal, prior to use in the process of the invention, is preferably ground in a suitable attrition machine, such as a hammermill, to a size such that at least 50 percent of the coal will pass through a 40-mesh (U.S. Series) sieve. The ground coal is then dissolved or slurried in a suitable solvent. If desired, the solid carbonaceous material can be treated, prior to reaction herein, using any conventional means known in the art, to remove therefrom any materials forming a part thereof that will not be converted to liquid herein under the conditions of the reaction. Typical analyses of various coals suitable for use are as follows:

| | |
|---|---|
| **High Volatile A** | |
| Sulfur | 1.33% |
| Nitrogen | 1.63 |
| Oxygen | 7.79 |
| Carbon | 80.88 |
| Hydrogen | 5.33 |
| Ash | 2.77 |
| **Sub-Bituminous** | |
| Sulfur | 0.21% |

-continued

| | |
|---|---|
| Nitrogen | 0.88 |
| Oxygen | 15.60 |
| Carbon | 65.53 |
| Hydrogen | 5.70 |
| Ash | 3.99 |
| Lignite | |
| Sulfur | 0.53% |
| Nitrogen | 0.74 |
| Oxygen | 32.04 |
| Carbon | 54.38 |
| Hydrogen | 5.42 |
| Ash | 5.78 |

Although "coal" is the principal material to be converted by the process of this invention, it need not be the only solid carbonaceous material converted. For example, from about 1 to 50 weight percent of materials such as municipal refuse, rubber (either natural or synthetic), cellulosic wastes, other waste polymers which heretofore have been buried, burned, or otherwise disposed of may be added to the "coal" feed. Also included is biomass which may be defined as a renewable carbon source such as grass, corn, trees, kelp and other sea weeds. The addition of such materials to this process increases the yield of valuable liquid fuel products from low-cost, relatively available material otherwise requiring disposal.

The following examples illustrate the best mode now contemplated for carrying out the invention.

EXAMPLES 1–4

In Table III below, a 300 cc stainless steel autoclave was charged with 5 grams of short contact time solvent refined coal (Examples 1–4) and Monterey coal (Example 5.) The feed of Examples 1–4 material was entirely soluble in tetrahydrofuran. The indicated amounts of hydrogen donor solvents and catalyst, if used, were added. The autoclave was sealed, pressure tested with argon, charged with one atmosphere argon, and heated in one to two hours with stirring to the temperature indicated. The system was held for the time and temperature indicated under autogeneous pressure with stirring, and then quenched within one to two minutes by forcing water through a cooling coil in contact with the autoclave contents. The vessel was opened and the contents washed out with tetrahydrofuran. The catalyst was Soxhlet extracted with tetrahydrofuran and the extract added to the other liquids. The solvent was then removed with a rotary evaporator. Distillation under vacuum yielded the 650° F.+solvent refined product.

EXAMPLE 5

In this example, the feed material was a Monterey coal similar to the feed from which the solvent refined coal of Examples 1–4 was generated. It contained 2.70 wt. % organic sulfur. In this example about 25 grams of coal was injected as approximately a 2:1 slurry in a synthetic solvent (~2% γ-picoline, 18% p-cresol, 42% tetralin, 38% 2-methyl naphthalene) into a preheated solvent of the same mixture. The mixture was stirred at 800° F. for 90 minutes under 1333 psi of hydrogen pressure. The mixture was quenched and worked up in the manner indicated above except that pyridine was used for the extraction. The solvent:coal ratio was 6:1.

TABLE III

| EXAMPLE | 1 | 2 | 3 | 4 | 5 |
|---|---|---|---|---|---|
| Feed 8 | ← | ← 5g MTSCSRC 10 each → | | → | MT coal |
| Catalyst | 5g 13X 1 | None | 5g Mn Nod 2 | 4.9Mn Nod 2 | None |
| Donor | 24.9g MeOH 3 | 25.1g MeOH 3 | 25.2g MeOH 3 | 25.4g Tetralin | Tetralin |
| Solvent | 49.8g 2MeN 4 | 50g 2MeN 4 | 50g 2MeN 4 | 50g 2MeN 4 | 5 |
| Temp °F. | 890 800 6 | (914–40 min) | 800 ± 16 | 804 | 800 |
| Time | 2 hr. | (800–80 min) | 2 hr. | 2 hr. | 90 min. |
| Pressure, psi | 2100 | 950 | 2065 | 530 | 1333 ($H_2$) |
| Yield SRC wt % 9 | 40 | 40 | 76 | 68 | 69 |
| Product % | | | | | |
| C | 86.6 | 91 | 88.6 | 87.89 | 85 |
| H | 5.7 | 6 | 5.9 | 5.76 | 5.9 |
| O | 4.3 | 1.7 | 2.9 | 4.11 | 5.8 |
| N | 1.5 | 1.0 | 1.3 | 1.27 | 1.7 |
| S | 1.8 | 1.13 | 0.5 | 0.75 | 1.5 |
| ash | 0.1 | — | 0.02 | 0.05 | — |
| Aromatic H | — | — | 46 | — | 44 |

1 13X = The sodium form of crystalline aluminosilicate known as faujasite
2 Mn Nod = Manganese nodules
3 MeOH = Methanol
4 2MeN = 2-Methyl Naphthalene
5 (~2% γ-picoline, 18% p-cresol, 42% tetralin, 38% 2-methyl naphthalene
6 Temperature lowered because of rising pressure
7 Final pressure; initially 1 atm. argon
8 Feed =
C 82.3 wt %
H 6.3
O 7.7
N 1.5
S 1.9
Ash 0.1
% Aromatic hydrogen 36
9 Yield of solvent refined coal only; not counting light liquids and gas
10 Monterey Short Contact Time Solvent Refined Coal From Table III it can be seen that the best desulfurization was brought about by manganese nodules in a donor solvent (methanol or tetralin) without $H_2$ (Examples 3 and 4). In addition, there was a substantial reduction in N, O, and ash (metal) components. With NaX molecular sieve (Example 1) the yield was low and desulfurization was negligible. In the blank reaction (no catalyst (Example 2) the yield was low and desulfurization was inadequate. Example 5 is a suitable reaction for comparison because the feed to the other runs is equivalent to the SCR produced in situ in about 4 minutes in Example 5. In this example, even with tetralin, and $H_2$, and coal minerals present as a possible catalyst, desulfurization only from 1.9 to 1.5 wt.% was achieved. To meet present boiler fuel specifications, however, sulfur contents should be approximately <0.9 wt.%.

The manganese nodules used in Examples 3 and 4 were obtained from the bottom of the Pacific Ocean. These nodules, after recovery from the ocean bottom, were washed to remove salt water and mud. They were then crushed, leached with boiling water five times, dried to constant weight at 100° C., and sieved to 14–30 mesh (U.S. Standard Sieve Series). The nodules had the following physical characteristics and chemical composition.

TABLE IV

| | |
|---|---|
| Surface area, square meters per gram ($m.^2/g^{-1}$) | 327 |
| Pore diameter, Angstrom units (A) | 53 |
| Pore volume, cubic centimeters per gram ($cm.^3/g^{-1}$) | 0.436 |
| Manganese (Mn), wt. percent | 25.0 |
| Iron (Fe). wt. percent | 15.0 |
| Nickel (Ni), wt. percent | <0.01 |
| Cobaltous oxide (CoO), wt. percent | <0.04 |
| Molybdenum trioxide ($MoO_3$), wt. percent | <0.08 |

EXAMPLE 6

Following the procedure set forth in Examples 1 to 5, bog iron ore obtained from Batsto, New Jersey, is washed to remove mud and other loose material. The ore is crushed, dried to a constant weight at 100° C. and sieved to 30 mesh (U.S. Series). Five grams of this sieved material is mixed with 5 grams of solvent refined coal (Monterey short contact time coal) and 75 grams of solvent consisting of 25 grams of isopropanol and 50 grams 2-methyl naphthalene. The mixture is heated to a temperature of 800° F. for 2 hours. After cooling, the reaction mixture is washed with tetrahydrofuran. The bog iron catalyst is then extracted with tetrahydrofuran and this extract is added to the other liquids. The solvent is removed by evaporation and upon subsequent distillation a solvent refined product of reduced sulfur nitrogen and ash content is obtained.

EXAMPLE 7

A sample of New Caledonia lateritic nickel ore had the following analysis:

| | weight % |
|---|---|
| Ni | 1.38 |
| Co | 0.092 |
| Total Fe | 41.5 |
| MgO | 3.75 |
| $Al_2O_3$ | 4.25 |
| $SiO_2$ | 7.40 |

Following the procedure set forth in Examples 1 to 5, this nickel ore is washed to remove mud and other loose material. The ore is crushed, dried to a constant weight at 100° C. and sieved to 25 mesh (U.S. Series). 5 grams of this sieved material is mixed with 5 grams of solvent refined coal (Monterey short contact time coal) and 75 grams of solvent consisting of 25 grams of methanol and 50 grams 2-methyl naphthalene. The mixture is heated to a temperature of 800° F. for 2 hours. After cooling, the reaction mixture is washed with tetrahydrofuran. The nickel catalyst is then extracted with tetrahydrofuran and this extract is added to the other liquids. The solvent is removed by evaporation and upon subsequent distillation a solvent refined coal product of reduced sulfur, nitrogen and ash content is obtained.

EXAMPLE 8

A sample of commercial bauxite had the following analysis:

| | Wt. % |
|---|---|
| $Al_2O_3$ | 3.6 |
| Fe | |
| $SiO_2$ | |
| $TiO_2$ | |
| Surface area, sq. meters per gram ($m.^2/g^{-1}$) | 198 |
| Particle Density | 1.53 |
| Pore Diameter, Angstrom Units (A.°) | 0.09 |
| Pore Volume, cubic centimeters/gram($Cm.^3/g^{-1}$) | .341 |
| Density | 3.6 |

Following the procedure set forth in Examples 1 to 5, the ore is crushed, dried to a constant weight at 100° C. and sieved to 30 mesh (U.S. Series). 5 grams of this sieved material is mixed with 5 grams of solvent refined coal (Monterey short contact time coal) and 75 grams of solvent consisting of 25 grams of tetralin and 50 grams 2-methyl naphthalene. The mixture is heated to a temperature of 800° F. for 2 hours. After cooling, the reaction mixture is washed with tetrahydrofuran. The bauxite catalyst is then extracted with tetrahydrofuran and this extract is added to the other liquids. The solvent is removed by evaporation and upon subsequent distillation a solvent refined product of reduced sulfur, nitrogen and ash content is obtained.

EXAMPLE 9

Following the procedure set forth in Examples 1 to 5, red mud having the following analysis is dried to a constant weight at 100° C. and sieved to 20 mesh (U.S. Series).

| | Wt. % | Grams |
|---|---|---|
| LOI | 11.73 | — |
| $SiO_2$ | 20.66 | 10.33 |
| $Fe_2O_3$ | 8.39 | 4.195 |
| $Na_2O$ | 18.66 | 9.33 |
| CaO | 7.16 | 3.58 |
| $Al_2O_3$ | 27.09 | 13.55 |
| $TiO_2$ | 1.68 | 0.84 |
| $SO_4$ | 2.75 | 1.38 |
| $CaO/SiO_2$ | .347 | |
| $Na_2O/Al_2O_3$ | .623 | |

5 grams of the above material is mixed with 5 grams of solvent refined coal (Monterey short contact time coal) and 75 grams of solvent consisting of 25 grams of tetralin and 50 grams 2-methyl naphthalene. The mixture is heated to a temperature of 800° F. for 2 hours. After cooling, the reaction mixture is washed with tetrahydrofuran. The red mud catalyst is then extracted with tetrahydrofuran and this extract is added to the other liquids. The solvent is removed by evaporation and upon subsequent distillation a solvent refined coal product of reduced sulfur, nitrogen and ash content is obtained.

What is claimed is:

1. A process for the desulfurization, demetalation and denitrogenation of coal or coal liquid charge stocks containing sulfur impurities which comprises contacting said charge stock in the absence of added hydrogen with a hydrogen donor solvent and with a catalyst comprising a naturally occurring porous metal ore selected from the group consisting of manganese nodules, bog iron, bog manganese, and nickel laterites.

2. The process of claim 1 wherein the porous metal ore is bog iron.

3. The process of claim 1 wherein the porous metal ore is bog manganese.

4. The process of claim 1 wherein the porous metal ore is nickel laterites.

5. The process of claim 1 wherein the porous metal ore is the underwater deposit known as manganese nodules.

6. The process of claims 2, 3, 4, or 5 wherein the the porous metal ore has been subjected to pretreatment by leaching or sulfiding.

7. The process of claim 5 wherein the manganese nodules have been washed with water having a temperature of at least 125° F. and a total salts content of not more than 1000 parts per million for a time sufficient to increase the accessible surface area of the nodules.

8. The process of claim 5 wherein said catalyst is a manganese nodule which contains copper, nickel or molybdenum in its composition and which has had at least a portion of its copper, nickel or molybdenum content removed therefrom.

9. The process of claim 8 wherein said at least a portion of its copper or nickel content has been removed from said manganese nodule by leaching said manganese nodule with an aqueous solution of acid.

10. The process of claim 8 wherein said at least a portion of its molybdenum content has been removed from said manganese nodule by leaching said manganese nodule with an aqueous solution of a base.

11. The process of claim 10 wherein said aqueous solution of a base has a pH of at least 8.

12. The process of claim 10 wherein said aqueous solution of a base has a pH of at least 10.

* * * * *